US007210945B1

(12) United States Patent
Ying

(10) Patent No.: US 7,210,945 B1
(45) Date of Patent: May 1, 2007

(54) HDMI CONNECTOR ASSEMBLY

(76) Inventor: Wan-Fa Ying, No. 56-7, Chun-Ing St., Shu-Lin City, Taipei Hsien (TW)

( * ) Notice: Subject to any disclaimer, the term of this patent is extended or adjusted under 35 U.S.C. 154(b) by 0 days.

(21) Appl. No.: 11/331,129

(22) Filed: Jan. 13, 2006

(51) Int. Cl.
*H01R 12/00* (2006.01)

(52) U.S. Cl. ..... 439/79

(58) Field of Classification Search ..... 439/79, 439/607, 609–610, 567, 571, 358, 492, 260, 439/80–81, 942, 635–636
See application file for complete search history.

(56) References Cited

U.S. PATENT DOCUMENTS 6,619,968 B2 * 9/2003 Xu ..... 439/79
6,648,697 B2 * 11/2003 Yang ..... 439/701
6,790,055 B1 * 9/2004 Shiu et al. ..... 439/79
2003/0109151 A1 * 6/2003 Xu ..... 439/79
2004/0023531 A1 * 2/2004 Wu ..... 439/79

* cited by examiner

*Primary Examiner*—J. F. Duverne
(74) *Attorney, Agent, or Firm*—Troxell Law Office, PLLC

(57) ABSTRACT

A HDMI connector assembly includes an insulative body including a body member including a central channel therethrough and parallel grooves on top and bottom of the channel, and a plate including two rows of parallel terminal cavities aligned with the grooves; an insulative seat provided in the channel and including a rear member including parallel furrows on its top and bottom, and a front member including parallel depressions; two rows of conductors provided in the depressions, the furrows, the grooves, and the terminal cavities, each conductor including a front electrical terminal and a rear solder member wherein the solder members of one row and the solder members of the other row are bent in opposite directions; and a housing for receiving the insulative body. The invention has advantages of increased quality and signal transmission performance, and causing no pollution.

7 Claims, 8 Drawing Sheets

HDMI CONNECTOR ASSEMBLY

BACKGROUND OF THE INVENTION

1. Field of Invention

The present invention relates to electrical connectors and more particularly to a HDMI (high definition multimedia interface) connector assembly with improved characteristics.

2. Description of Related Art

A conventional HDMI electrical connector is for transmitting data, audio, and video signals along a cable and has a high performance transmission interface independent of cable length. The well known connector is fixedly connected to PCB (printed circuit board) (not shown) by soldering. Also, conductor spacing is very small (e.g., about 1 mm) and solder area is thus small. Further, it is difficult of soldering. Furthermore, solder may connect two adjacent thin electrical terminals together and result some of the terminals in short-circuit. Also, it is difficult to control the soldering quality.

As shown in FIGS. 1 to 3, a PCB 92 is inserted between two rows of conductors 91 in the conventional HDMI connector assembly 90. Hence, both conductor spacing and solder area are increased and thus soldering is facilitated and short-circuit is eliminated. However, a number of drawbacks are still found as detailed below.

Soldering both PCB and connector assembly is required. It is often that such soldering process will easily raise defects in some of soldering points on both PCB and connector assembly, resulting in a signal transmission performance degradation. Further, due to the above reasons, its production is low. Furthermore, pollution may occur in the PCB soldering. Moreover, two ends 93 of the conventional HDMI connector assembly are communicated with each other, thus sealing two ends 93 of the connector assembly prior to final sealing of the whole connector assembly is necessary and this may increase the complexity of manufacturing processes. Thus, it may lower yield. Hence, a need has arisen for an improved HDMI connector assembly in order to overcome the drawbacks of the prior art.

SUMMARY OF THE INVENTION

It is therefore an object of the present invention to provide a HDMI electrical connector assembly having advantages of increased solder quality, high yield, increased signal transmission performance.

In one aspect of the present invention there is provided a HDMI female, electrical connector assembly comprising an insulative body including a body member including a central channel therethrough and a plurality of parallel grooves on top and bottom of the channel, and a plate including two rows of a plurality of parallel terminal cavities aligned with the grooves; an insulative seat provided in the channel and including a rear member including a plurality of parallel furrows on its top and bottom, and a front member including a plurality of parallel depressions; two rows of a plurality of conductors provided in the depressions, the furrows, the grooves, and the terminal cavities, each conductor including a front electrical terminal and a rear solder member wherein the solder members of one row and the solder members of the other row are bent in opposite directions; and a housing including an internal space for receiving the insulative body.

In another aspect of the present invention there is provided a HDMI male, electrical connector assembly comprising an insulative body including a body member including a central channel therethrough and a plurality of parallel grooves on top and bottom of the channel, and a plate including two rows of a plurality of parallel terminal cavities aligned with the grooves, and a central tunnel through the plate; an insulative seat provided in the channel and including a rear member including a plurality of parallel furrows on its top and bottom, and a front member including a central projection and top and bottom rows of a plurality of parallel depressions in communication with the furrows; two rows of a plurality of conductors provided in the depressions, the furrows, the grooves, and the terminal cavities, each conductor including a front electrical terminal and a rear solder member wherein the solder members of one row and the solder members of the other row are bent in opposite directions; and a housing including an internal space for receiving the insulative body.

The above and other objects, features and advantages of the present invention will become apparent from the following detailed description taken with the accompanying drawings.

DETAILED DESCRIPTION OF THE INVENTION

Figure 1:
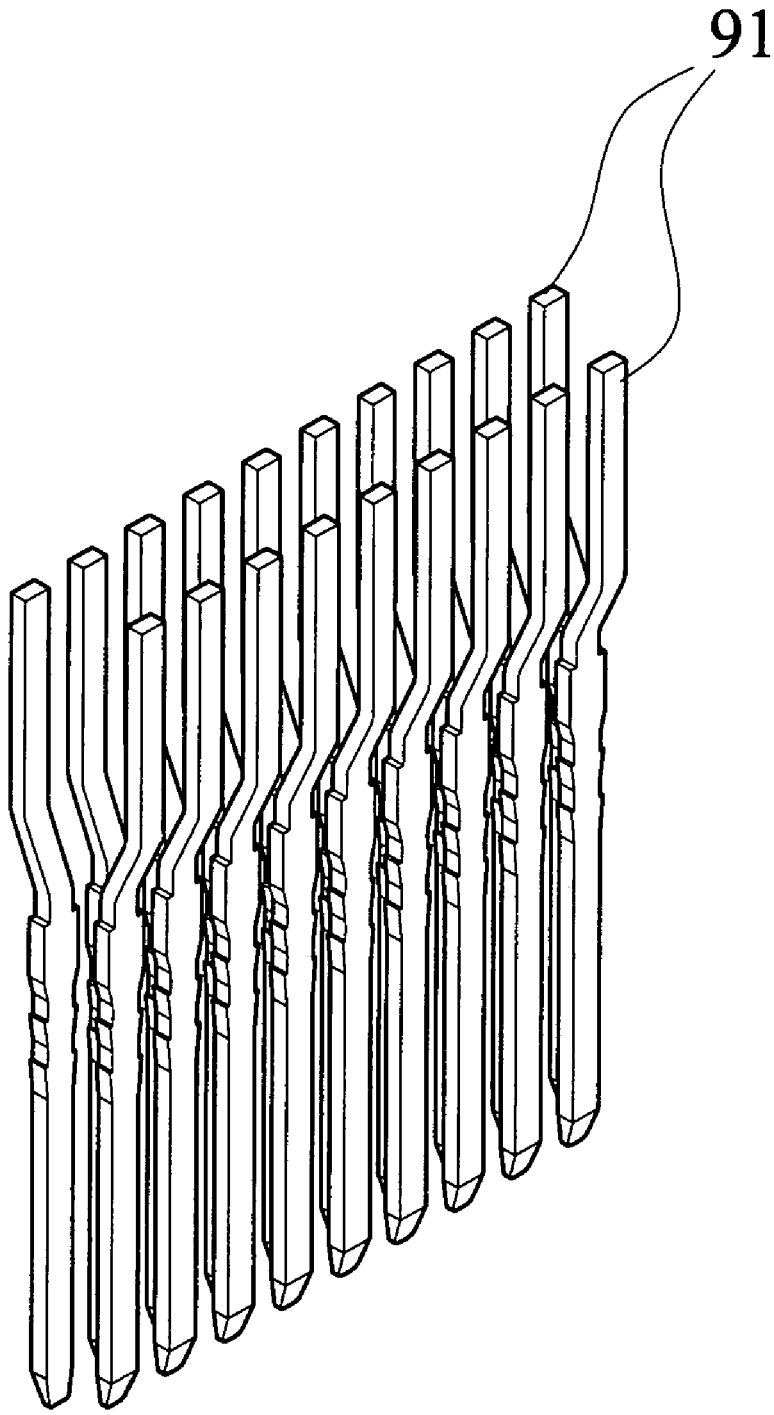
FIG. 1(PRIOR ART)
FIG. 1 is a perspective view of conductors in a conventional HDMI connector assembly.
Figure 3:
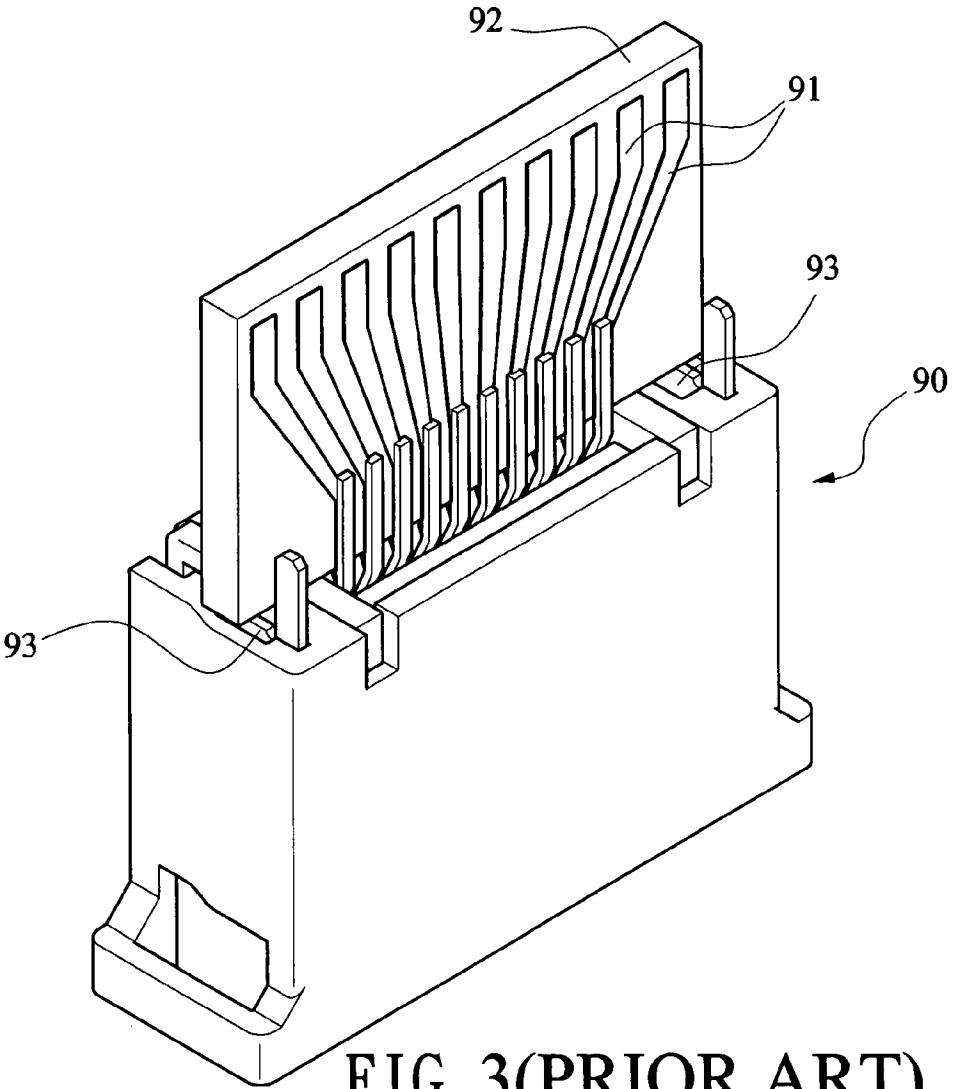
FIG. 3(PRIOR ART)
FIG. 3 is a perspective view of the conventional HDMI connector assembly with portions broken away.
Figure 2:
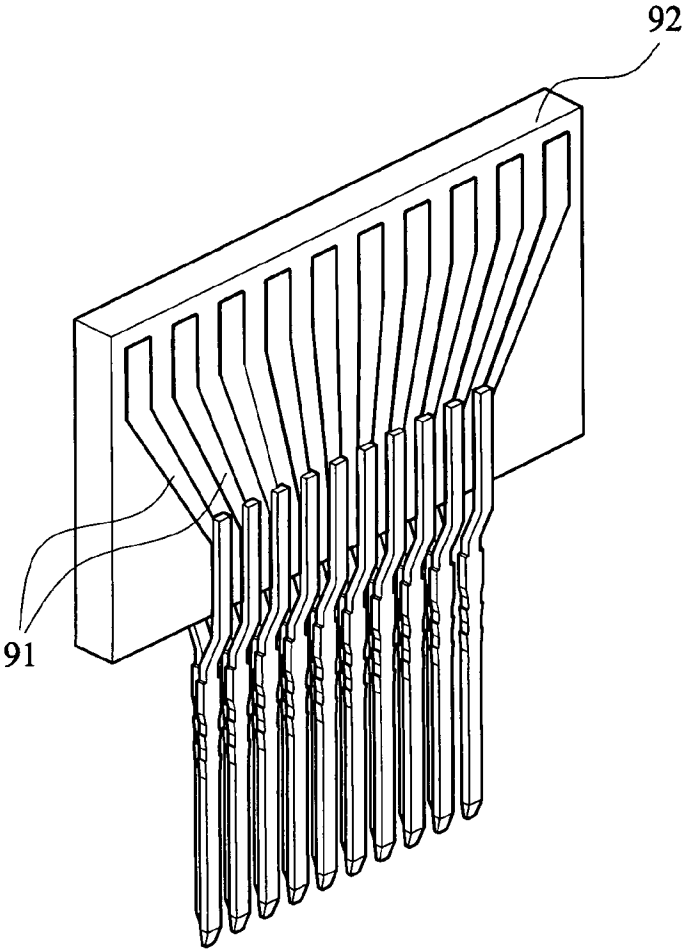
FIG. 2(PRIOR ART)
FIG. 2 is a perspective view of the conductors and sandwiched PCB in the conventional HDMI connector assembly.
Figure 4:
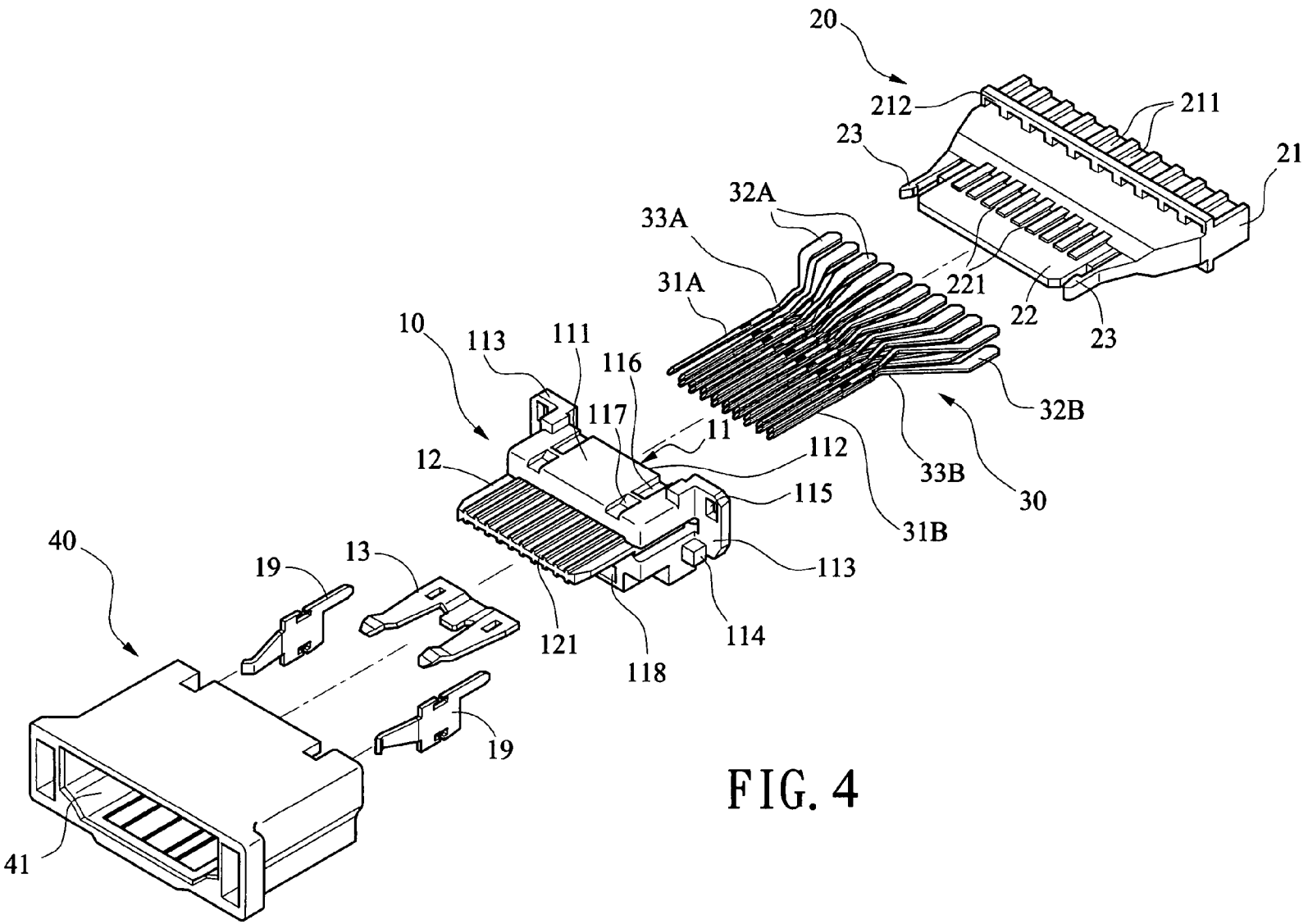
FIG. 4 is an exploded view of a first preferred embodiment of HDMI connector assembly according to the invention.
Figure 5:
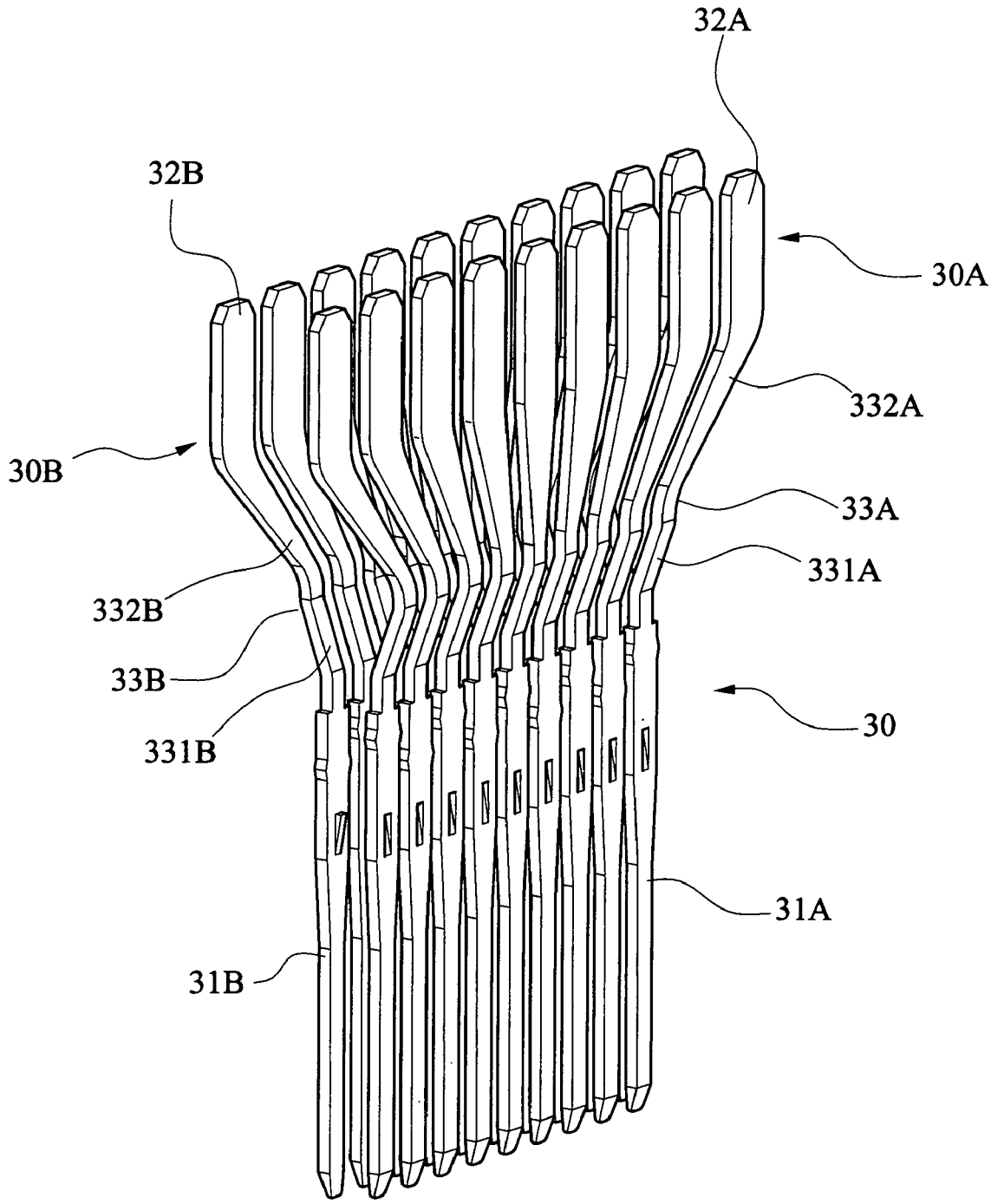
FIG. 5 is a perspective view of the conductors of FIG. 4.
Figure 7:
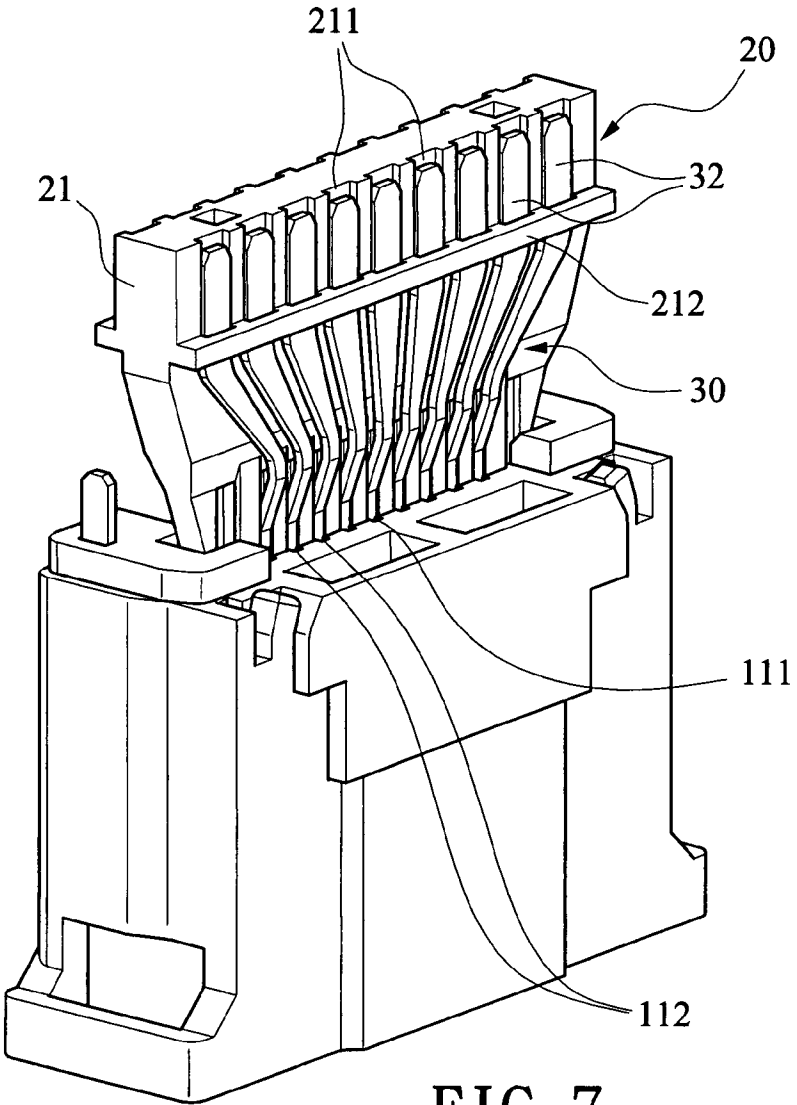
FIG. 7 is a perspective view of the assembled HDMI connector assembly of FIG. 4.
Figure 6:
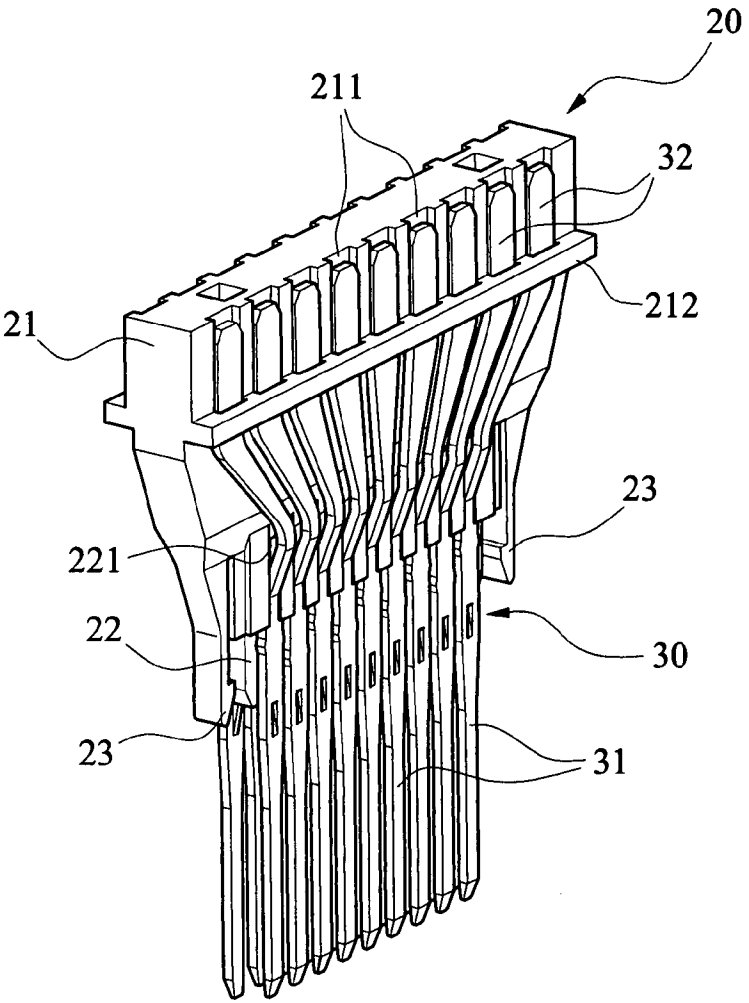
FIG. 6 is a perspective view of the assembled insulative seat and the conductors of FIG. 4.

Referring to FIGS. 4 to 7, a female HDMI connector assembly in accordance with a first preferred embodiment of the invention comprises an insulative body 10, an insulative seat 20, two rows of a plurality of conductors 30, and a housing 40. Each component is discussed in detailed below. The insulative body 10 comprises a body member 11 and a plate 12. The body member 11 includes a central channel 111 through the body member 11, a plurality of parallel grooves 112 on top and bottom of the channel 111, two side wings 113, two positioning blocks 114 each adjacent the wing 113, two holes 115 each on the wing 113, two troughs 116 each adjacent side of a top, two ridges 117 each in the trough 116, and a lower slot 118 under the plate 12. The insulative body 10 further comprises a resilient member 13 fitted in the slot 118. The plate 12 comprises two rows of a plurality of parallel terminal cavities 121 aligned with the grooves 112.

The insulative seat 20 comprises a rear member 21 including a plurality of parallel relatively wider furrows 211 on each of its top and bottom, and transverse top and bottom flanges 212 in front of and above the furrows 211, a front member 22 including a plurality of parallel relatively narrower depressions 221, and two side latches 23 with the front member 22 disposed therebetween. The plurality of parallel relatively wider furrows 211 on each of its top and bottom and the plurality of parallel relatively narrower depressions 221 are corresponding thereto each other. The conductor 30 comprises an upper row terminals 30A and a lower row terminals 30B. The upper row terminals 30A comprises a front electrical terminal 31A, a flat and wide rear solder member 32A and a bending middle portion 33A. The bending middle portion 33A further comprises a first upward bending portion 331A and a second downward bending portion 332A wherein the second downward bending portion 332A has gradually increased its wideness and smoothly connecting with the flat and wide rear solder member 32A. The lower row terminals 30B comprises a front electrical terminal 31B, a flat and wide rear solder member 32B and a bending middle portion 33B. The bending middle portion 33B further comprises a first downward bending portion 331B and a second upward bending portion 332B wherein the second upward bending portion 332B has gradually increased its wideness and smoothly connecting with the flat and wide rear solder member 32B. Moreover, in order to obtain relatively wider spaces between each of rear solder members 32A and 32B, all of the second downward bending portions 332A and second upward bending portions 332B except the center one are such arranged to bend outward and laterally that the more near location of the outer side one with respect to the center one of the row of the second bending portions 332A and 332B is, the more bending angle toward outward and laterally will be such that an arrangement of two layers of sector type of terminal row is obtained. Also, the solder member 32A and 32B are relatively flat and wide for increasing solder area. The housing 40 comprises an internal space 41 for receiving the insulative body 10.

An assembly of the first preferred embodiment of the invention will be described in detailed below. First, insert the front member 22 into the channel 111 with the front electrical terminals 31A and 31B, the middle portions 33A and 33B and the rear solder members 32A and 32B of the conductors 30 received in the terminal cavities 121, the grooves 112, the depressions 221, and the furrows 211, respectively. Also, the solder members 32*a* and 32B pass the tunnels of the top and bottom flanges 212 and are held in place. Assemble the insulative body 10 and the insulative seat 20 in the housing 40 with the positioning blocks 114 and the ridges 117 of the insulative body 10 urged against an inner wall of the space 41 of the housing 40. Two resilient elements 19 each is biased between one side of the insulative body 10 and one side of the space 41 and has a pointed end inserted through the hole 115. At this assembled state, the rear member 21 is extended from the housing 40 and the wings 113 are disposed externally of the housing 40.

By configuring as above, prior drawbacks are substantially overcome. These drawbacks include provision of PCB and associated pollution, increased complexity of manufacturing processes, and low yield. Moreover, two sides of the housing are sealed by the wings 113 of the insulative body 10. Thus, the prior sealing process is also eliminated.

Figure 8:
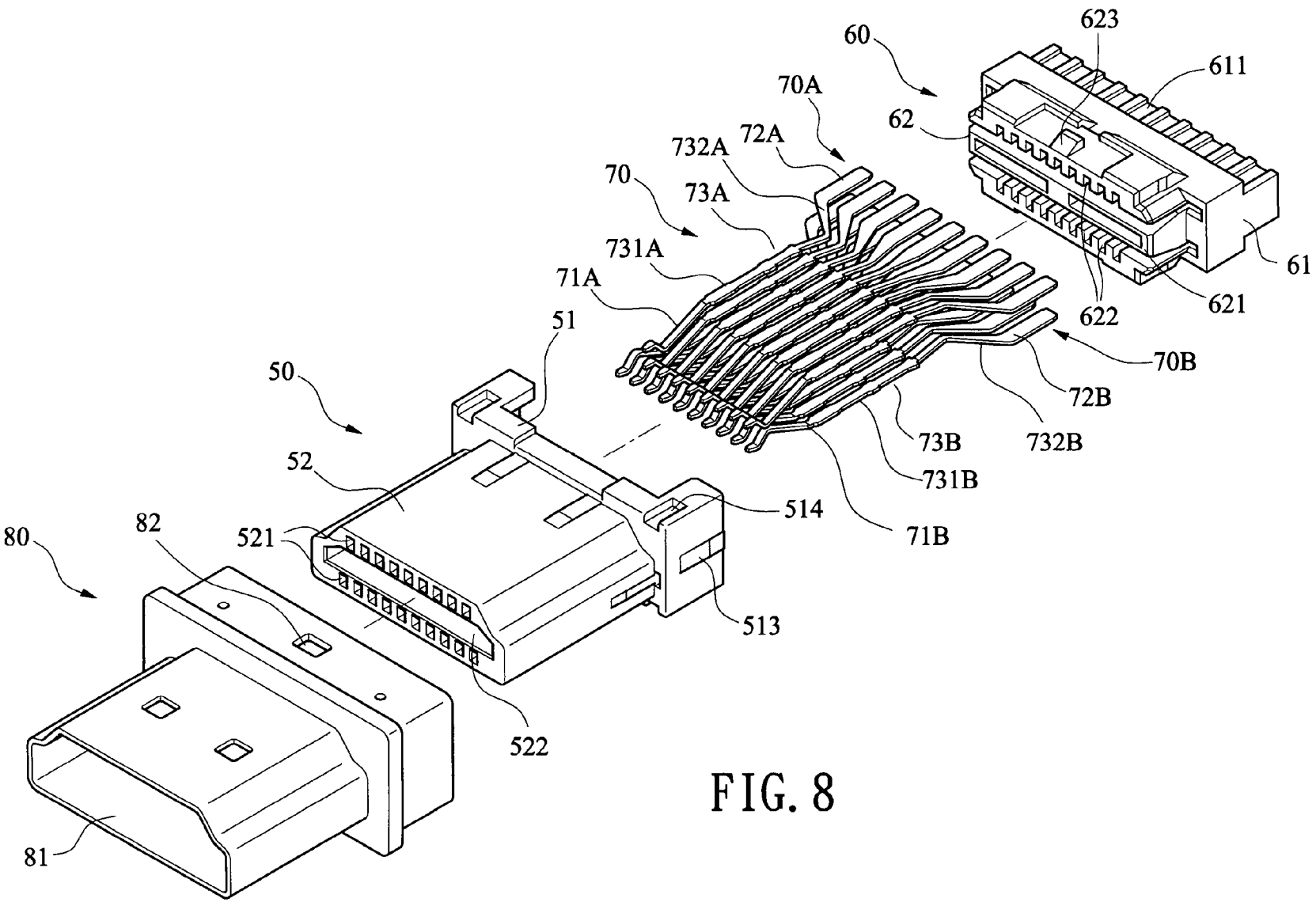
FIG. 8 is an exploded view of a second preferred embodiment of HDMI connector assembly according to the invention.
Figure 8A:
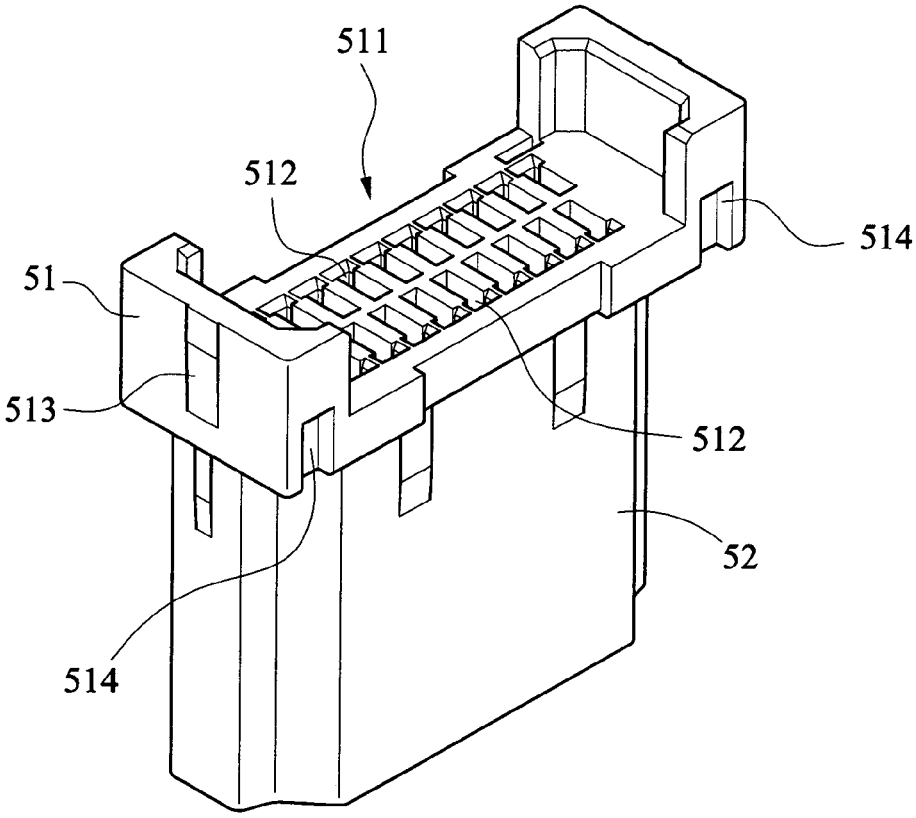
FIG. 8A is a perspective view of the insulative body of FIG. 8.
Figure 8B:
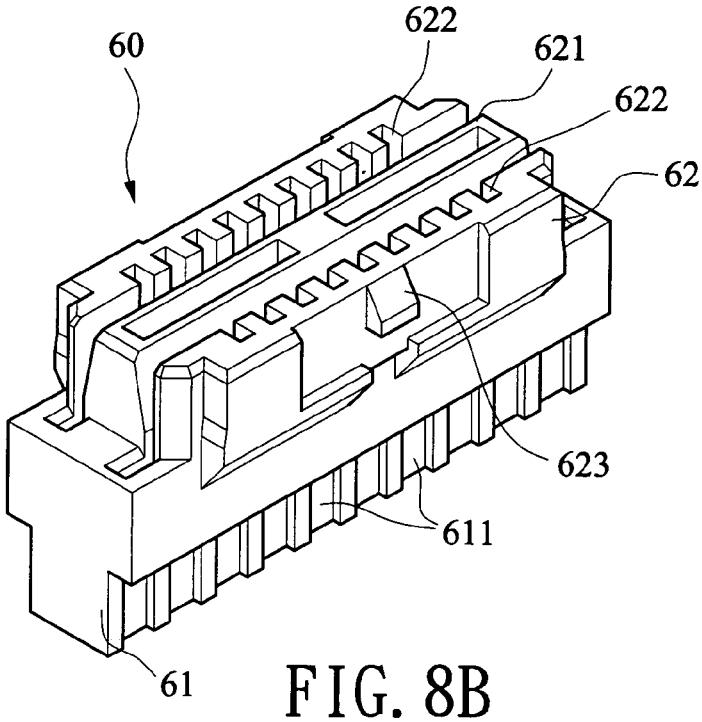
FIG. 8B is a perspective view of the insulative seat of FIG. 8.
Figure 9:
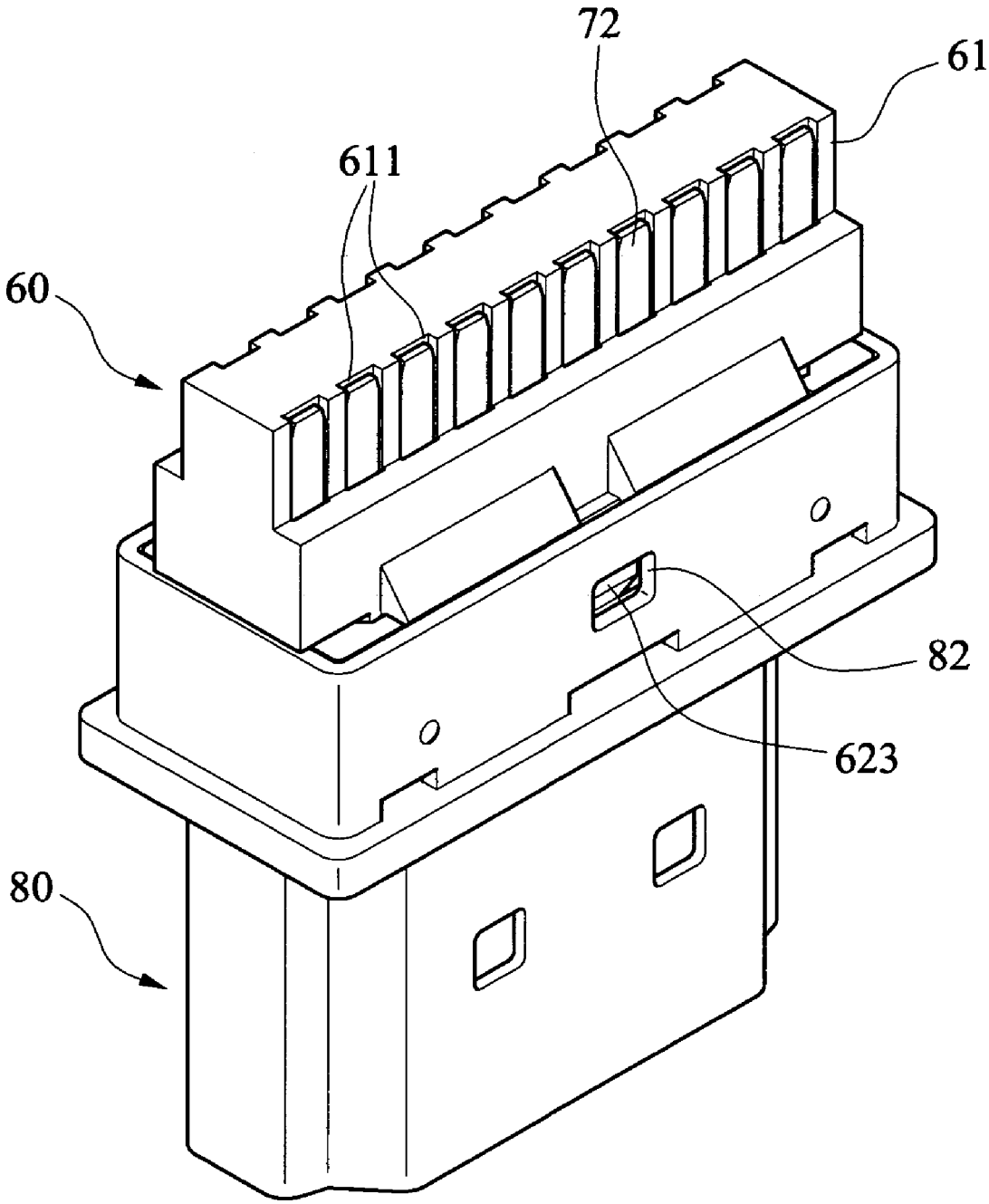
FIG. 9 is a perspective view of the assembled HDMI connector assembly of FIG. 8.

Referring to FIGS. 8, 8A, 8B, and 9, a male HDMI connector assembly in accordance with a second preferred embodiment of the invention comprises an insulative body 50, an insulative seat 60, two rows of a plurality of conductors 70, and a housing 80. Each component is discussed in detailed below. The insulative body 50 comprises a body member 51 and a plate 52. The body member 51 includes a central channel 511 through the body member 51, a plurality of parallel grooves 512 on top and bottom of the channel 511, two side wings 513, and two positioning slots 514 each on the wing 513. The plate 52 comprises top and bottom rows of a plurality of parallel terminal cavities 521 aligned with the grooves 512, and a central tunnel 522 through the plate 52 for receiving the plate 12 (see FIG. 4).

The insulative seat 60 comprises a rear member 61 including a plurality of parallel furrows 611 on each of its top and bottom, and a front member 62 including a central projection 621, top and bottom rows of a plurality of parallel depressions 622 in communication with the furrows 611, and top and bottom tabs 623. The conductor 70 comprises an upper row terminals 70A and a lower row terminals 70B. The upper row terminals 70A comprises an open-mouth V shaped front electrical terminal 71A, a flat and wide rear solder member 72A and a middle portion 73A. The middle portion 73A further comprises a first plane portion 731A and a second downward bending portion 732A wherein the second downward bending portion 732A has gradually increased its wideness and smoothly connecting with the flat and wide rear solder member 72A. The lower row terminals 70B comprises a reversed open-mouth V shaped front electrical terminal 71B, a flat and wide rear solder member 72B and a middle portion 73B. The middle portion 73B further comprises a first plane bending portion 731B and a second downward bending portion 732B wherein the second downward bending portion 732B has gradually increased its wideness and smoothly connecting with the flat and wide rear solder member 72B. Moreover, in order to obtain relatively wider spaces between each of rear solder members 72A and 72B, all of the second downward bending portions 732A and 732B except the center one are such arranged to bend laterally and outward that the more near location of the outer side one with respect to the center one of the row of the second bending portions 332A and 332B is, the more bending angle toward outward and laterally will be such that an arrangement of two layers of sector type of terminal row is obtained. Also, the solder members 72 and 72B are relatively flat and wide for increasing solder area. The housing 80 comprises an internal space 81 for receiving the insulative body 50, and top and bottom holes 82 for receiving the tabs 623 of the insulative seat 60 therein.

An assembly of the second preferred embodiment of the invention will be described in detailed below. First, insert the front member 62 into the channel 511 with the front electrical terminals 71A and 71B, the middle portions 73A and 73B and the rear solder members 72A and 72B of the conductors 70 received in the terminal cavities 521, the grooves 512, the depressions 622, and the furrows 611, respectively. Assemble the insulative body 50 and the insulative seat 60 in the housing 80 with the wings 513 urged against an inner wall of the space 81 and the tabs 623 of the insulative seat 60 latched in the holes 82 of the housing 80. At this assembled state, the rear member 61 is extended from the housing 80.

While the invention herein disclosed has been described by means of specific embodiments, numerous modifications and variations could be made thereto by those skilled in the art without departing from the scope and spirit of the invention set forth in the claims.

What is claimed is:

1. A Hi-definition Multimedia Interface (HDMI) female electrical connector assembly comprising:

an insulative body including a body member (11) including a central channel (111) therethrough, a plurality of parallel grooves (112) on a top and a bottom of the channel (111), two side wings (113) each at a side of the channel (111), two positioning blocks (114) each adjacent the wings (113), two holes (115) each provided on the wing (113), two troughs (116) each adjacent a side of a top of the body member (11), two ridges (117) each in the trough (116), and a lower slot (118) in a bottom of the body member (11), and a plate (12) including two rows of a plurality of parallel terminal cavities (121) aligned with the grooves (121);

an insulative seat (20) provided in the channel (111) and comprising a rear member (21) including a plurality of parallel furrows (211) on a top and a bottom thereof, and transverse top and bottom flanges (212), and a front member (22) including a plurality of parallel depressions (221) and two side latches (23) with the front member (22) disposed therebetween;

a conductor assembly (30) provided in the depressions (221), the furrows (211), the grooves (112), and the terminal cavities (121), the assembly comprising an upper row terminal (30A) including a front electrical terminal (31A), a flat and wide rear solder member (32A) and a bending middle portion (33A), wherein the bending middle portion (33A) further comprises a first upward bending portion (331A) and a second downward bending portion (332A) in which the second downward bending portion (332A) has gradually increased its wideness and smoothly connecting with the flat and wide rear solder member (32A); and a lower row terminals (30B) including a front electrical terminal (31B), a flat and wide rear solder member (32B and a bending middle portion (33B), wherein the bending middle portion (33B) further comprises a first downward bending portion (331B) and a second upward bending portion (332B) in which the second upward bending portion (332B) has gradually increased its wideness and smoothly connecting with the flat and wide rear solder member (32B), wherein in order to obtain relatively wider spaces between each of rear solder members (32A) and (32B), all of the second downward bending portions (332A) and second upward bending portions (332B) except the center one are such arranged to bend outward and laterally that the more near location of the outer side one with respect to the center one of the row of the second bending portions (332A) and (332B) is, the more bending angle toward outward and laterally will be such that an arrangement of two layers of sector type of terminal row is obtained; and a housing (40) including an internal space (41) for receiving the insulative body (10).

2. The HDMI female, electrical connector assembly of claim 1, wherein the insulative body further (10) comprises a resilient member (13) fitted in the slot (118).

3. The HDMI female, electrical connector assembly of claim 1, wherein the solder member is relatively flat and wide for increasing solder area.

4. The HDMI female, electrical connector assembly of claim 1, wherein the insulative body (10) further comprises two resilient elements (19) each biased between its one side and one side of the housing interior and having a pointed end inserted through the hole (115) of the insulative body (10).

5. A Hi-definition Multimedia Interface (HDMI) male, electrical connector assembly comprising:

an insulative body (50) including a body member (51) including a central channel (511) therethrough, a plurality of parallel grooves (512) on a top and a bottom of the channel (511), two side wings (513) each at a side of the insulative body (50), and two positioning slots (514) each on the wing (513), and a plate (52) including a top and a bottom rows of a plurality of parallel terminal cavities (521) aligned with the grooves (512), and a central tunnel (522) through the plate (12);

an insulative seat (60) provided in the channel (511) and including a rear member (61) including a plurality of parallel furrows (611) on a top and a bottom thereof, and a front member (62) including a central projection (621) and a top and a bottom rows of a plurality of parallel depressions (622) in communication with the furrows (611) and a top and bottom tabs (623);

a conductors assembly (70) provided in the depressions (622), the furrows (611), the grooves (512), and the terminal cavities (521), the assembly (70) comprising an upper row terminals (70A) including an open-mouth V shaped front electrical terminal (71A), a flat and wide rear solder member (72A) and a middle portion (73A) wherein the middle portion (73A) further comprises a first plane portion (731A) and a second downward bending portion (732A) in which the second downward bending portion (732A) has gradually increased its wideness and smoothly connecting with the flat and wide rear solder member (72A); and a lower row terminals (70B) including a reversed open-mouth V shaped front electrical terminal (71B), a flat and wide rear solder member (72B) and a middle portion (73B) wherein the middle portion (73B) further comprises a first plane bending portion (731B) and a second downward bending portion (732B) in which the second downward bending portion (732B) has gradually increased its wideness and smoothly connecting with the flat and wide rear solder member (72B);

wherein in order to obtain relatively wider spaces between each of rear solder members (72A) and (72B), all of the second downward bending portions (732A) and (732B) except the center one are such arranged to bend laterally and outward that the more near location of the outer side one with respect to the center one of the row of the second bending portions (332A) and (332B) is, the more bending angle toward outward and laterally will be such that an arrangement of two layers of sector type of terminal row is obtained; and a housing (80) including an internal space (81) for receiving the insulative body (50).

6. The HDMI female, electrical connector assembly of claim 5, wherein the solder members (72A) and (72B) are relatively flat and wide for increasing solder area.

7. The HDMI female, electrical connector assembly of claim 5, wherein the insulative seat (60) further comprises a top and a bottom tabs (623), and wherein the housing (80) further comprises a top and a bottom holes (82) with the top and the bottom tabs (623) of the insulative seat (60) received therein.

* * * * *